US010978772B1

(12) United States Patent
Podell et al.

(10) Patent No.: US 10,978,772 B1
(45) Date of Patent: Apr. 13, 2021

(54) BALUN-BASED FOUR-PORT TRANSMISSION-LINE NETWORKS

(71) Applicant: Werlatone, Inc., Brewster, NY (US)

(72) Inventors: Allen F. Podell, Palo Alto, CA (US); Ky-Hien Do, Carp (CA); Mariama Dadhi Barrie, Brewster, NY (US)

(73) Assignee: Werlatone, Inc., Patterson, NY (US)

( * ) Notice: Subject to any disclaimer, the term of this patent is extended or adjusted under 35 U.S.C. 154(b) by 0 days.

(21) Appl. No.: 17/081,871

(22) Filed: Oct. 27, 2020

(51) Int. Cl.
*H01P 5/16* (2006.01)
*H01P 1/20* (2006.01)

(52) U.S. Cl.
CPC . *H01P 5/16* (2013.01); *H01P 1/20* (2013.01)

(58) Field of Classification Search
CPC ..... H01P 5/16; H01P 1/20
USPC ..... 333/128
See application file for complete search history.

(56) References Cited

U.S. PATENT DOCUMENTS

| | | | |
|---|---|---|---|
| 2,470,307 | A | 5/1949 | Guanella |
| 3,091,743 | A | 5/1963 | Wilkinson |
| 3,103,638 | A | 9/1963 | Greuet |
| 3,237,130 | A | 2/1966 | Cohn |
| 3,239,781 | A | 3/1966 | Podell |
| 3,262,075 | A | 7/1966 | Podell |
| 3,311,850 | A | 3/1967 | Podell |
| 3,325,587 | A | 6/1967 | Sontheimer |
| 3,327,220 | A | 6/1967 | Podell |
| 3,370,257 | A | 2/1968 | Spierling |
| 3,399,340 | A | 8/1968 | Podell |
| 3,428,886 | A | 2/1969 | Kawashima et al. |
| 3,484,724 | A | 12/1969 | Podell |
| 3,508,171 | A | 4/1970 | Podell |
| 3,516,025 | A | 6/1970 | Podell |
| 3,529,265 | A | 9/1970 | Podell |
| 3,629,733 | A | 12/1971 | Podell |
| 3,761,843 | A | 9/1973 | Cappucci |
| 3,883,828 | A | 5/1975 | Cappucci |

(Continued)

FOREIGN PATENT DOCUMENTS

CA 742816 A 9/1966

OTHER PUBLICATIONS

Gerst, C.W., "Electrically Short 90° Couplers Utilizing Lumped Capacitors", Microwave Symposium Digest, G-MTT International, May 1967, vol. 67, Issue 1, pp. 58-62.

(Continued)

*Primary Examiner* — Robert J Pascal
*Assistant Examiner* — Kimberly E Glenn
(74) *Attorney, Agent, or Firm* — Kolisch Hartwell, P.C.

(57) ABSTRACT

In a four-port transmission-line network, a first transmission line is connected to a first port, second and third transmission lines are connected to a first component port, fourth and fifth transmission lines are connected to a second component port, and a sixth transmission line is connected to a fourth port. The transmission lines are connected as baluns to the ports with the unbalanced signal on the port side and the balanced signals interconnecting with others of the transmission lines. In another example, two or more baluns are connected serially. Each balun includes two transmission lines having signal-return conductors connected together at the ends. One end of a signal conductor on the first balun forms a sum port. One end of the signal-return conductors of the second balun forms a difference port, and a capacitor connects the other end of the signal-return conductors to circuit ground.

8 Claims, 7 Drawing Sheets

(56) References Cited

U.S. PATENT DOCUMENTS

| | | | |
|---|---|---|---|
| 3,980,972 | A | 9/1976 | Podell et al. |
| 3,988,705 | A | 10/1976 | Drapac |
| 4,011,528 | A | 3/1977 | Podell et al. |
| 4,129,838 | A | 12/1978 | Wallington |
| 4,222,016 | A | 9/1980 | Stock et al. |
| 4,263,559 | A | 4/1981 | Ho |
| 4,395,670 | A | 7/1983 | Podell |
| 4,554,518 | A | 11/1985 | Baer |
| 4,556,856 | A | 12/1985 | Presser |
| 4,626,806 | A | 12/1986 | Rosar et al. |
| 4,636,755 | A | 1/1987 | Gibbs |
| 4,647,868 | A | 3/1987 | Mueller |
| 4,700,152 | A | 10/1987 | Wilson |
| 4,721,929 | A | 1/1988 | Schnetzer |
| 4,774,481 | A | 9/1988 | Edwards et al. |
| 4,800,345 | A | 1/1989 | Podell et al. |
| 4,825,220 | A | 4/1989 | Edward et al. |
| 4,851,795 | A | 7/1989 | Beckwith |
| 4,916,410 | A | 4/1990 | Littlefield |
| 4,937,541 | A | 6/1990 | Podell et al. |
| 4,952,895 | A | 8/1990 | Quan |
| 5,008,639 | A | 4/1991 | Pavio |
| 5,121,090 | A | 6/1992 | Garuts et al. |
| 5,206,611 | A | 4/1993 | Russell |
| 5,285,175 | A | 2/1994 | Edwards |
| 5,296,823 | A | 3/1994 | Dietrich |
| 5,304,959 | A | 4/1994 | Wisherd et al. |
| 5,352,994 | A | 10/1994 | Black et al. |
| 5,412,354 | A | 5/1995 | Quan |
| 5,461,349 | A | 10/1995 | Simons |
| 5,568,111 | A | 10/1996 | Metsler |
| 5,697,088 | A | 12/1997 | Gu |
| 5,745,017 | A | 4/1998 | Ralph |
| 5,847,625 | A | 12/1998 | Gillette |
| 5,889,444 | A | 3/1999 | Johnson et al. |
| 5,926,076 | A | 7/1999 | Johnson et al. |
| 5,977,842 | A | 11/1999 | Brown et al. |
| 5,982,252 | A | 11/1999 | Werlau |
| 6,130,588 | A | 10/2000 | Gallivan et al. |
| 6,150,897 | A | 11/2000 | Nishikawa et al. |
| 6,236,272 | B1 | 5/2001 | Takei et al. |
| 6,246,299 | B1 | 6/2001 | Werlau |
| 6,285,273 | B1 | 9/2001 | Morikawa |
| 6,294,965 | B1 | 9/2001 | Merrill et al. |
| 6,300,848 | B1 | 10/2001 | Miyaji et al. |
| 6,407,648 | B1 | 6/2002 | Johnson |
| 6,472,950 | B1 | 10/2002 | London |
| 6,486,749 | B1 | 11/2002 | Tichauer et al. |
| 6,570,466 | B1 | 5/2003 | Bahl |
| 6,750,752 | B2 | 6/2004 | Werlau |
| 6,822,531 | B2 | 11/2004 | Carlson |
| 6,914,512 | B2 | 7/2005 | Park et al. |
| 6,972,639 | B2 | 12/2005 | Podell |
| 6,982,609 | B1 | 1/2006 | McKay et al. |
| 7,042,309 | B2 | 5/2006 | Podell |
| 7,068,122 | B2 | 6/2006 | Weng et al. |
| 7,132,906 | B2 | 11/2006 | Podell |
| 7,138,887 | B2 | 11/2006 | Podell |
| 7,142,052 | B2 | 11/2006 | Zelley |
| 7,190,240 | B2 | 3/2007 | Podell |
| 7,202,760 | B2 | 4/2007 | Podell |
| 7,245,192 | B2 | 7/2007 | Podell |
| 7,274,267 | B2 | 9/2007 | Saitou et al. |
| 7,345,557 | B2 | 3/2008 | Podell |
| 7,430,291 | B2 | 9/2008 | Washburn et al. |
| 7,663,449 | B2 | 2/2010 | Podell |
| 7,692,512 | B2 | 4/2010 | Podell |
| 7,801,493 | B2 | 9/2010 | Do |
| 7,839,232 | B2 | 11/2010 | London |
| 8,248,180 | B2 | 8/2012 | Podell |
| 8,248,181 | B2 | 8/2012 | Podell |
| 8,482,362 | B1 | 7/2013 | Podell |
| 8,493,162 | B1 | 7/2013 | Podell |
| 8,570,116 | B2 | 10/2013 | Podell |
| 8,598,964 | B2 | 12/2013 | Podell |
| 8,648,669 | B1 | 2/2014 | Podell |
| 8,704,611 | B2 | 4/2014 | Podell et al. |
| 9,325,051 | B1 | 4/2016 | Podell et al. |
| 2008/0018412 | A1 | 1/2008 | Podell |
| 2010/0301963 | A1 | 12/2010 | Podell |
| 2011/0074519 | A1 | 3/2011 | Podell |

OTHER PUBLICATIONS

Cohn, Seymour B. "A Class of Broadband Three-Port TEM-Mode Hybrids." IEEE Transactions on Microwave Theory and Techniques. vol. MTT-16, No. 2. Feb. 1968, pp. 110-116.

Nagai, N., et al. "New n-Way Hybrid Power Dividers." Microwave Symposium Digest, 1977, IEEE MTT-S International Digital Object Indentifier. 1977, pp. 503-505.

Russell, Kenneth J., "Microwave Power Combining Techniques", IEEE Transactions on Microwave Theory and Techniques, May 1979, vol. MTT-27, No. 5, pp. 472-478.

Illingworth, Valerie (editor), Definition of the word "balun", The Penguin Dictionary of Electronics, Second Edition, Copyright 1988, p. 30, Penguin Books.

Horowitz et al., "Stubs, baluns, and transformers", The Art of Electronics, Second Edition, Copyright 1989, Section 13.10, pp. 881-882, Cambridge University Press.

Rogers Corporation, "RT/duroid 5870/5880 High Frequency Laminates" data sheet, Copyright 1989-2006 Rogers Corporation (Revised Nov. 2006), 2 pages.

Monteath, G.D., "Coupled Transmission Lines as Symmetrical Directional Couplers", Proc. IEE, May 1955, vol. 102, Part B, No. 3, pp. 383-392.

An et al., "A 50:1 Bandwidth Cost-Effective Coupler with Sliced Coaxial Cable", IEEE MTT-S Digest, 1996, 4 pages.

Alexanian, Angelos, "Planar and Distributed Spatial Power Combiners" doctoral dissertation, University of Califomia Santa Barbara, Jun. 1997, 119 pages.

Cheng et al., "A 120-W X-Band Spatially Combined Solid-State Amplifier", IEEE Transactions on Microwave Theory and Techniques, Dec. 1999, vol. 47, No. 12, pp. 2557-2561.

Park, Ung-Hee, et al. "A 700- to 2500-MHz Microstrip Balun Using a Wilkinson Divider and 3-dB Quadrature Couplers." Microwave and Optical Technology Letters. vol. 47, No. 4. Nov. 20, 2005, pp. 333-335.

Kim et al., "Ultra-wideband uniplanar MMIC balun using field transformations", Electronics Letters, Mar. 16, 2006, vol. 42, No. 6, 2 pages.

Microwave Encyclopedia—microwaves101.com, "Baluns", downloaded from www.microwaves101.com/encyclopedia/baluns.cfm, updated Nov. 26, 2006 and downloaded Aug. 1, 2007, 4 pages.

The Southgate Amateur Radio Club, "Techtip: Coax Balun by G8MNY", downloaded from www.southgatearc.org on Aug. 3, 2007, 2 pages.

Storr, Wayne, "Mutual Inductance," retreived from www.electronics-tutorials.ws/inductor/mutual-inductance.html on Nov. 29, 2012, 4 pages, dated Oct. 11, 2009.

www.radio-electronics.com; "RF Combiners, Splitters and Hybrids" (text assembled from https://www.electronics-notes.com/articles/radio/rf-combiner-splitter-coupler-hybrid/primer-summary.phpand further linked pages); at least as early as Aug. 30, 2012, 11 pages.

Tyco Electronics; Microwave Hybrid Junction (data sheet); at least as early as Aug. 30, 2012; 2 pages.

M/A-COM, "RF Directional Couplers and 3dB Hybrids Overview" application note, M/A-COM Division of AMP Incorporated, Oct. 12, 2014, 10 pages.

Wikipedia; "Power dividers and directional couplers" (downloaded from en.wikipedia.org/wiki/Power_dividers_and_directional_couplers); retreived Aug. 25, 2020, last edited Aug. 23, 2020, 17 pages.

Harty, Daniel D. "Novel Design of a Wideband Ribcage-Dipole Array and its Feeding Network." Thesis Submitted to the Faculty of the Worcester Polytechnic Institute, Dec. 17, 2010, 106 pages.

BALUN-BASED FOUR-PORT TRANSMISSION-LINE NETWORKS

FIELD

This disclosure relates to transmission-line networks. More specifically, the disclosed embodiments relate to four-port transmission-line networks that may be used as dividers and combiners.

INTRODUCTION

A magic tee (or magic T or hybrid tee) coupler is a four-port hybrid or 3 dB coupler used in microwave systems. It is an alternative to the rat-race coupler. In contrast to the rat-race, the magic tee is a three-dimensional waveguide structure. Magic-tee couplers are also implemented in the form of stripline asymmetrical couplers and stripline quadrature couplers with a 90-degree delay line.

The magic comes from the way it prevents signals from propagating between certain ports under specific conditions. This allows it to be used as a duplexer; for instance, it can be used to isolate the transmitter and receiver in a radar system while sharing the antenna. In practical examples, it is used to both isolate circuits and mix signals, for instance in a COHO radar.

The name magic tee is derived from the way in which power is divided among the four waveguide ports. A signal injected into the H-plane or sum port will be divided equally between two component ports and will be in phase. A signal injected into the E-plane or difference port will also be divided equally between the component ports, but will be 180 degrees out of phase. If signals are fed in through the component ports, they are added at the H-plane port and subtracted at the E-plane port.

SUMMARY

The present disclosure provides a four-port transmission-line network having a sum port, component ports, and a difference port. In some embodiments, a four-port transmission-line network may include six transmission lines. Each transmission line has first and second ends, signal and signal-return conductors having corresponding respective ends, and a length corresponding to a quarter of a design-frequency wavelength.

A first transmission line includes a first signal conductor and a first signal-return conductor. A first end of the first signal conductor is connected to a first port and the first end of the first signal-return conductor is connected to a circuit ground. The second end of the first signal conductor is connected to a first circuit node and the second end of the first signal-return conductor is connected to a second circuit node.

A second transmission line includes a second signal conductor and a second signal-return conductor. A first end of the second signal conductor is connected to a second port and the first end of the second signal-return conductor is connected to the circuit ground. The second end of the second signal conductor is connected to a third circuit node and the second end of the second signal-return conductor is connected to the second circuit node.

A third transmission line includes a third signal conductor and a third signal-return conductor. A first end of the third signal conductor is connected to a third port and the first end of the third signal-return conductor is connected to the circuit ground. The second end of the third signal conductor is connected to a fourth circuit node and the second end of the third signal-return conductor is connected to the second circuit node.

A fourth transmission line includes a fourth signal conductor and a fourth signal-return conductor. A first end of the fourth signal conductor is connected to the second port and the first end of the fourth signal-return conductor is connected to the circuit ground. The second end of the fourth signal conductor is connected to the first circuit node and the second end of the fourth signal-return conductor is connected to the fourth circuit node.

A fifth transmission line includes a fifth signal conductor and a fifth signal-return conductor. A first end of the fifth signal conductor is connected to the third port and the first end of the fifth signal-return conductor is connected to the circuit ground. The second end of the fifth signal conductor is connected to the first circuit node and the second end of the fifth signal-return conductor is connected to the third circuit node.

A sixth transmission line includes a sixth signal conductor and a sixth signal-return conductor. A first end of the sixth signal conductor is connected to a fourth port and the first end of the sixth signal-return conductor is connected to the circuit ground. The second end of the sixth signal conductor is connected to the fourth circuit node and the second end of the sixth signal-return conductor is connected to the third circuit node.

In some embodiments, a four-port transmission-line network includes four transmission lines and a capacitor connected to circuit ground. A first transmission line includes a first conductor and a second conductor. The first conductor has a first end connected to a first port for conducting a signal relative to a circuit ground. The second conductor has a first end that is open-circuited and disposed proximate to the first end of the first conductor.

A second transmission line includes a third conductor and a fourth conductor. The third conductor has a first end connected to circuit ground. The fourth conductor has first and second ends connected to respective first and second ends of the second conductor. The first end of the fourth conductor is proximate to the first end of the third conductor.

A third transmission line includes a fifth conductor and a sixth conductor. The fifth conductor has a first end connected to a second end of the first conductor and a second end connected to a second port. The sixth conductor has first and second ends that are proximate to respective first and second ends of the fifth conductor.

A fourth transmission line includes a seventh conductor and an eighth conductor. The seventh conductor has a first end connected to the second end of the third conductor and a second end connected to a third port. The eighth conductor has first and second ends connected to respective first and second ends of the sixth conductor. The first and second ends of the eighth conductor are proximate to respective first and second ends of the seventh conductor. The first ends of the sixth and eighth conductors are connected to the first capacitor. The second ends of the sixth and eighth conductors are connected to a fourth port.

Features, functions, and advantages may be achieved independently in various embodiments of the present disclosure, or may be combined in yet other embodiments, further details of which can be seen with reference to the following description and drawings.

DESCRIPTION

Figure 1:
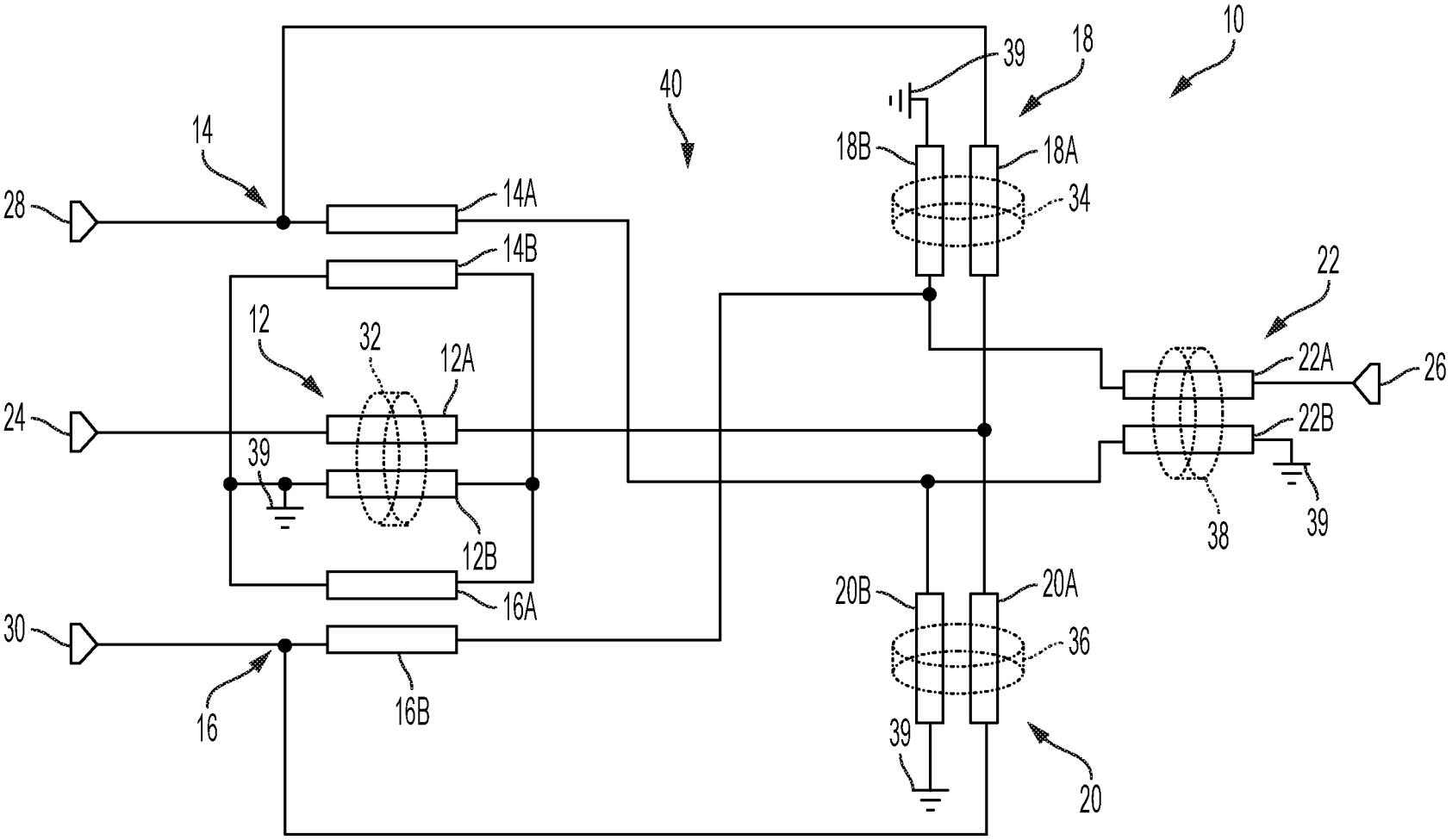
FIG. 1 is a schematic diagram showing a first example of a four-port transmission-line network.

Various embodiments of a transmission-line network having four ports are described below and illustrated in the associated drawings. Unless otherwise specified, a four-port transmission-line network and/or its various components may, but are not required to, contain at least one of the structure, components, functionality, and/or variations described, illustrated, and/or incorporated herein. Furthermore, the structures, components, functionalities, and/or variations described, illustrated, and/or incorporated herein in connection with the present teachings may, but are not required to, be included in other transmission-line networks. The following description of various embodiments is merely exemplary in nature and is in no way intended to limit the disclosure, its application, or uses. Additionally, the advantages provided by the embodiments, as described below, are illustrative in nature and not all embodiments provide the same advantages or the same degree of advantages.

Two conductors are electrically connected when there is an electron current path between them, including any conductors and electron-conductive electrical elements, such as resistors, and inductors, but not coupling by either electromagnetic induction such as inductive coupling or capacitive coupling, or electromagnetic radiation, such as radio waves and microwave power transmission. Two conductors or other components are directly electrically connected when there are no intervening electrical elements. Electrical components connected in series conduct a common current sequentially through the electrical components. Electrical components connected exclusively in series conduct only a common current sequentially through the electrical components. Electrical components connected in parallel have a common voltage across the electrical components. Electrical components connected exclusively in parallel are connected between the same circuit nodes and have only the same voltage across each of the electrical components.

Ordinal terms such as "first", "second", and "third" are used to distinguish or identify various members of a group, or the like, in the order they are introduced in a particular context and are not intended to show serial or numerical limitation, or be fixed identifiers for the group members. Accordingly, the ordinal indicator used for a particular element may vary in different contexts. Unless otherwise indicated, the terms "first," "second," "third," etc. are used herein merely as labels, and are not intended to impose ordinal, positional, or hierarchical requirements on the components to which these terms refer. Moreover, reference to, e.g., a "second" component does not require or preclude the existence of a lower-numbered item (e.g., a "first" item) and/or a higher-numbered component (e.g., a "third" item).

Where "a" or "a first" element or the equivalent thereof is recited, such usage includes one or more such elements, neither requiring nor excluding two or more such elements.

The following sections describe selected aspects of exemplary transmission-line networks as well as related circuits and components. The examples in these sections are intended for illustration and should not be interpreted as limiting the entire scope of the associated concepts. Each section may include one or more distinct inventions, and/or contextual or related information, function, and/or structure.

Transmission lines disclosed herein may be constructed as one of various forms well known in the art. For example, a transmission line may be a coaxial transmission line, as shown in FIGS. 2-7, twisted pair, stripline, coplanar waveguide, slot line, or microstrip line. Whatever the form, each transmission line may include a pair of electrically spaced apart, inductively coupled conductors that conduct or transmit a signal defined by a voltage difference between the conductors. These conductors may be described interchangeably as a signal conductor and a signal-return conductor.

Example 1

Figure 2:
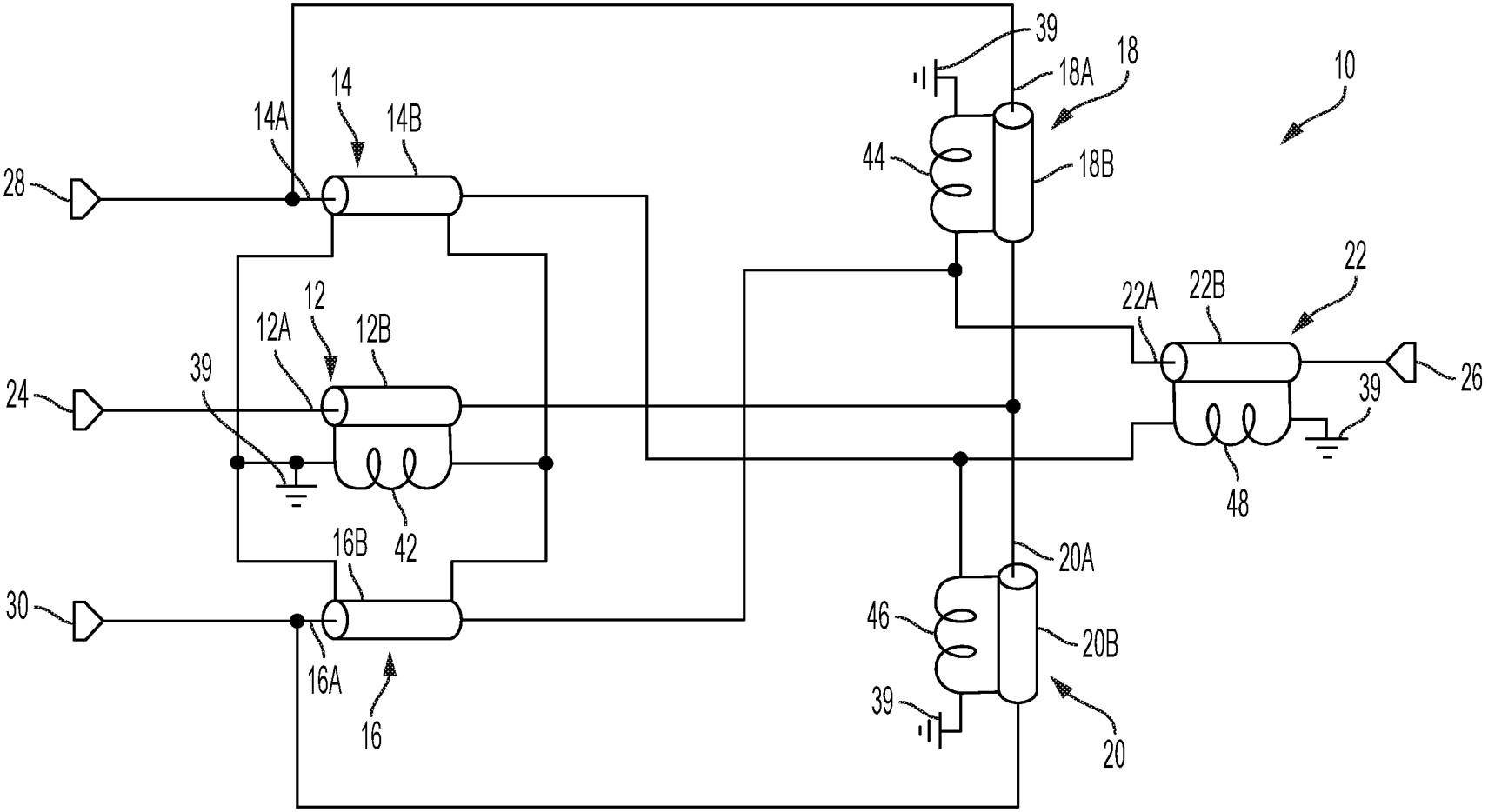
FIG. 2 is a schematic diagram showing an example of the transmission-line network of FIG. 1

As depicted in FIGS. 1 and 2, a four-port transmission-line network 10 may include a plurality of transmission lines such as first transmission line 12, second transmission line 14, third transmission line 16, fourth transmission line 18, fifth transmission line 20, and sixth transmission line 22. Each one of transmission lines 12, 14, 16, 18, 20, and 22 may be constructed as one of various forms well known in the art as has been mentioned. The transmission lines illustrated in FIG. 1 are represented as wire conductors. The reference numbers of the components and features used for the circuit of FIG. 1 are also used for the circuit of FIG. 2, which circuit is described below.

Whatever the form, each transmission line may include a pair of electrically spaced apart, inductively coupled conductors that conduct or transmit a signal defined by a voltage difference between the conductors. These conductors may be described interchangeably as a signal conductor and a signal-return conductor. In the drawings, signal conductors are given the designation "A" appended to the transmission line reference number and signal-return conductors are given the designation "B." For example, the signal conductor of transmission line 12 is designated with reference numeral 12A and the signal-return conductor of transmission line 12 is designated with reference numeral 12B. Other transmission lines are designated in similar fashion. Accordingly, transmission lines 14, 16, 18, 20, and 22 have signal conductors 14A, 16A, 18A, 20A, and 22A, and signal-return conductors 14B, 16B, 18B, 20B, and 22B.

Figure 3:
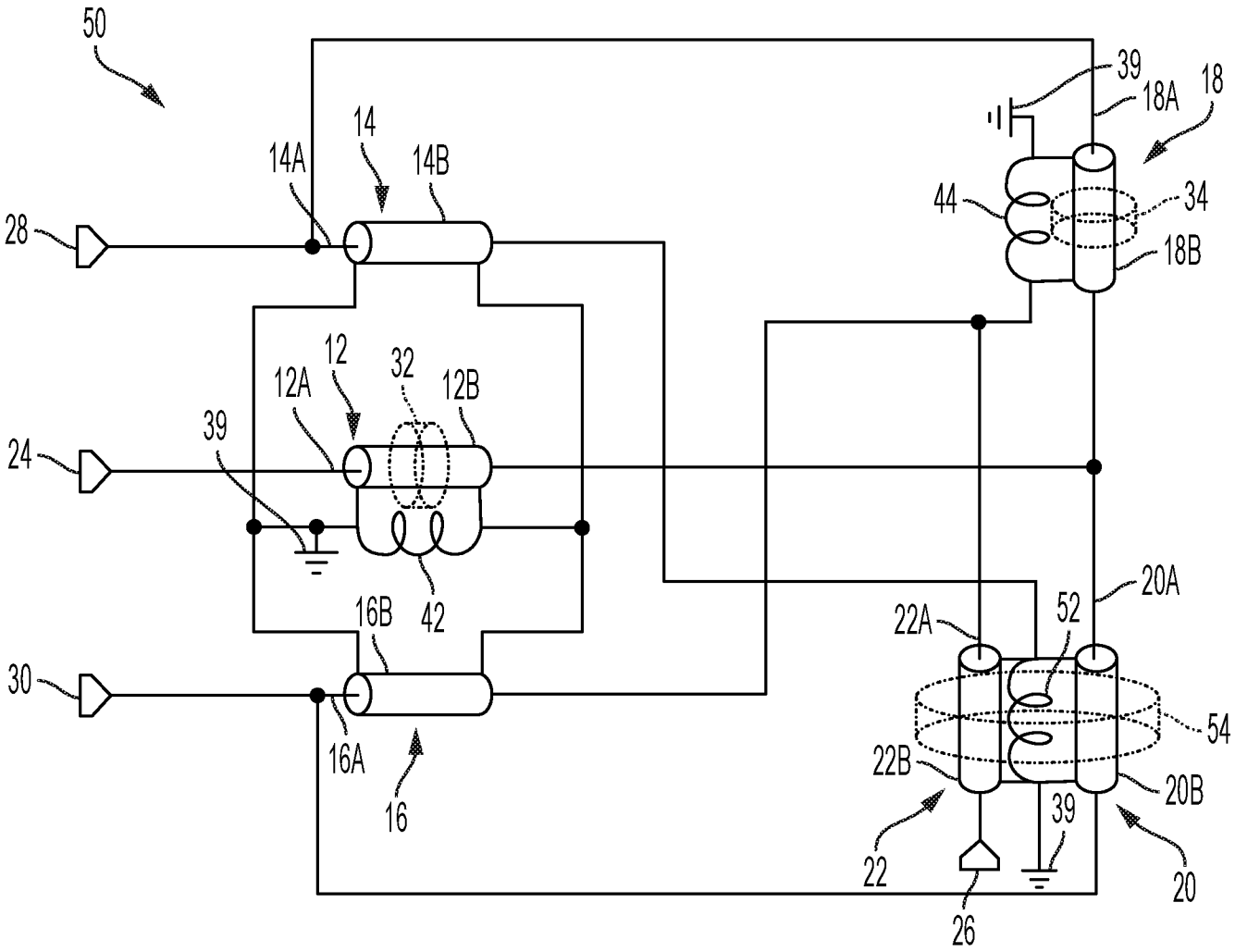
FIG. 3 is a schematic diagram showing yet a further example of the transmission-line network of FIG. 1

In some types of transmission lines a signal-return conductor may be a shield conductor, as in a coaxial transmission line, as shown in FIGS. 2 and 3, or a strip line. For a strictly single-ended or unbalanced signal, a signal-return conductor may also be referred to as a ground conductor, whether or not it is connected to a local ground, a circuit ground, a system ground, or an earth ground. A signal conductor may be referred to as a shielded conductor or as a center conductor, such as in the coaxial transmission lines shown in FIGS. 2 and 3. Some or all of transmission lines 12, 14, 16, 18, 20, and 22 may have equal lengths or differing lengths depending on the intended phase relationships desired.

To provide a frame of reference in the following description, one end of each of transmission lines 12, 14, 16, 18, and 20 are connected together at what is referred to as an interconnection region 40. The ends of the transmission lines that are connected together in interconnection region 40 are referred to as the first ends, and the ends opposite the first ends are referred to as the second ends. Using this terminology, sum port 24 is at the second end of the signal conductor 12A of transmission line 12; difference port 26 is at the second end of signal conductor 22A, the connection of the second ends of signal conductors 14A and 18A forms component port 28, and the connection of the second ends of signal conductors 16A and 20A forms component port 30. Each port may be a place where characteristics of transmission-line network 10 may be defined, whether accessible or not. Transmission-line network 10 may also be referred to as a combiner/divider circuit, a divider/combiner, a divider, or a combiner, it being understood that signals and power may be conducted in either direction through them to either combine multiple inputs into a single output or to divide a single input into multiple outputs.

In this example of transmission-line network 10, the first ends of signal-return conductors 12B, 14B, and 16B of the first, second, and third transmission lines, respectively, are electrically directly connected together. The second ends of signal-return conductors 12B, 14B, and 16B are all connected to a circuit ground 39. In the coaxial embodiment of FIG. 2, these signal-return conductors are connected together by connecting corresponding ends of the respective coaxial shields to one another.

In this example, the first end of signal conductor 12A is directly connected in interconnection region 40 to the first ends of signal conductor 18A and signal conductor 20A in a branching configuration as shown in FIGS. 1 and 2. The first end of signal conductor 14A is electrically directly connected to the first ends of signal-return conductors 20B and 22B. In the example of FIG. 2, the center conductor of second transmission line 14 in interconnection region 40 is directly connected to the shield of fourth transmission line 18. In similar fashion, the first end of signal conductor 16A is electrically directly connected to the first end of signal-return conductor 18B and the first end of signal conductor 22A. With reference to FIG. 2, the center conductor of third transmission line 16 is directly connected to the shield of fourth transmission line 18 and to the center conductor of transmission line 22. The second ends of signal-return conductors 18B, 20B, and 22B are all connected to circuit ground 39.

A transmission line may be configured to form a balun having an unbalanced or single-ended signal applied at one end where the signal-return conductor is connected to circuit ground, and a balanced or differential signal at the other end. The voltage difference between the signal and signal-return conductors stays the same along the transmission line, but the voltage on each conductor relative to ground gradually changes progressing from the unbalanced-signal end toward the balanced-signal end. At the balanced-signal end, the voltage relative to circuit ground on the signal conductor may be half the voltage on the signal conductor at the unbalanced-signal end, and the voltage on the signal-return conductor may be the negative complement of the voltage on the signal conductor. This arrangement leads to a voltage variation or gradient along the length of the transmission line relative to circuit ground, because the voltages on the signal conductor and the signal-return conductor transition between the different voltages at each end.

It will be appreciated that the respective transmission lines are connected like baluns with single-ended signals on the ports and differential signals in interconnection region 40. The structure of the balun may produce spurious signals between a conductor and circuit ground, which spurious signals may be choked by a ferrite sleeve extending around the conductor. A ferrite sleeve may be a block, bead, ring, or layers of ferrite material configured as appropriate to suppress high frequency spurious signals, noise, or other signals relative to ground on the transmission line. Transmission lines having unshielded conductors with the same voltage to ground may use a common ferrite sleeve. Combining transmission lines in a single ferrite sleeve may reduce overall hysteresis losses caused by the ferrite.

Combiner/divider 10 may also include one or more ferrite sleeves, such as a first ferrite sleeve 32 extending around transmission line 12, a second ferrite sleeve 34 extending around transmission line 18, a third ferrite sleeve 36 extending around transmission line 20, and a fourth ferrite sleeve 38 extending around transmission line 22. Since the signal-return conductors 12B, 14B, and 16B are each grounded at one end and connected together electrically at the other end, they have the same voltage with respect to ground and may be choked using the same ferrite sleeve, such as first ferrite sleeve 32.

In FIGS. 2 and 3, inductors are shown in parallel with the respective shield signal-return conductors to represent the ferrite sleeve loading produced by the ferrite sleeves shown in FIG. 1. This representation is used for performing simulations on the circuits shown. Specifically, an inductor 42 is connected in parallel to shield signal-return conductor 12B of coaxial transmission line 12. Similarly, respective inductors 44, 46, and 48 are connected in parallel respectively to shield conductors 18B, 20B, and 22B of respective coaxial transmission lines 18, 20, and 22.

Example 2

A transmission-line network, shown generally at 50 in FIG. 3, is similar to transmission-line network 10 shown in FIG. 2. That is, the various transmission lines are coaxial transmission lines and ferrite loading is represented by various inductors. The interconnections between the various transmission lines and between the transmission lines and the nodes remains the same. To the extent that the components of the circuit are the same, the same reference numbers are used and the description of FIG. 2 to matter that is common to FIG. 3 thus also applies to FIG. 3.

A difference between transmission-line network 10 and transmission-line network 50 is that transmission line 22 does not have a separate inductor 48 or corresponding ferrite sleeve 38. Rather, transmission lines 20 and 22 are positioned proximate to and alongside each other, and share a common inductor 52. The corresponding ends of the shield conductors of these two coaxial transmission lines are connected together, so the voltages along shield signal-return conductors 20B and 22B are the same. Inductor 52 represents ferrite loading of a ferrite sleeve 54 that surrounds both of coaxial lines 20 and 22. With this sharing of a common ferrite sleeve by two of the transmission lines, transmission-line network 50 may be configured in a smaller area and have fewer components.

Example 3

Figure 4:
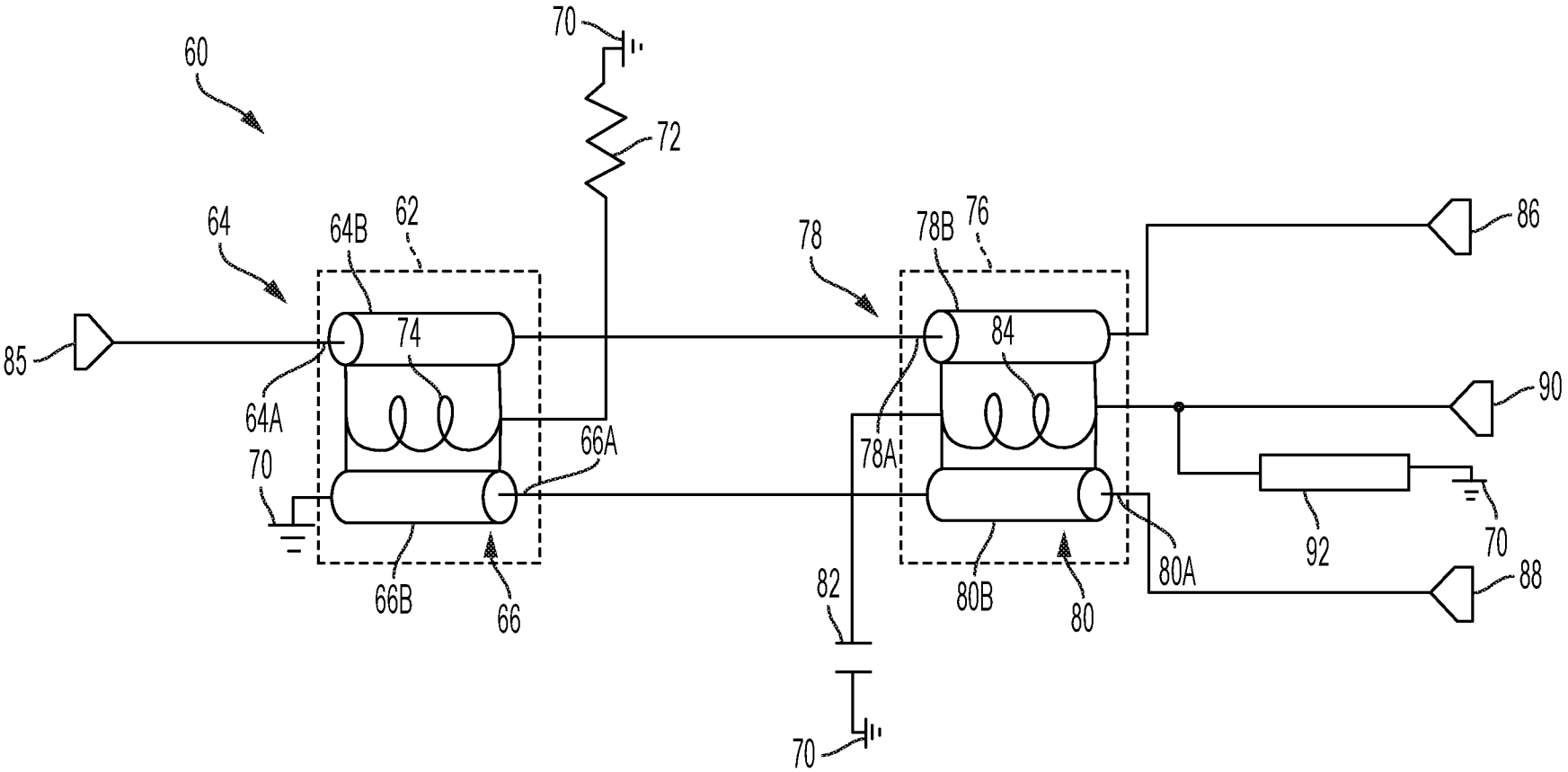
FIG. 4 is a schematic diagram showing a second example of a four-port transmission-line network having two balun sections configured as paired transmission lines.

FIG. 4 illustrates a transmission-line network shown generally at 60 that is based on transmission-line pairs formed as baluns connected serially or sequentially. A first balun 62 includes a first transmission line 64 proximate to a second transmission line 66. Transmission lines 64 and 66 have respective center or signal conductors 64A and 66A and shield or signal-return conductors 64B and 66B. Signal or center conductors 64A and 66A are electrically isolated from each other by outer shield conductors 64B and 66B. A first end of signal conductor 64A is connected to an unbalanced-signal or difference port 68. The corresponding end of signal conductor 66A is connected to a circuit ground 70. A corresponding first end of shield conductors 64B and 66B are connected together and are otherwise open-circuited. A resistor 72 may connect the opposite, second ends of shield conductors 64B and 66B to circuit ground 70. In some examples, resistor 72 is omitted, leaving the associated end of the shield conductors open-circuited. An inductor 74 is connected in parallel to opposite ends of shield signal-return conductors 64B and 66B to represent the loading of a ferrite sleeve surrounding both of transmission lines 64 and 66.

A second balun 76 is connected to the second end of balun 62. Balun 76 includes a first transmission line 78 proximate to a second transmission line 80. Transmission lines 78 and 80 have respective center or signal conductors 78A and 80A and shield or signal-return conductors 78B and 80B. Signal or center conductors 78A and 80A are electrically isolated from each other by outer shield conductors 78B and 80B. A first end of signal conductor 78A is connected to the second end of signal conductor 64A of transmission line 64. A first end of signal conductor 80A is connected to the second end of signal conductor 66A of transmission line 66. A corresponding first end of shield conductors 78B and 80B are connected together and a capacitor 82 connects these first ends of shield conductors 78B and 80B to circuit ground 70. An inductor 84 is connected in parallel to opposite ends of shield signal-return conductors 78B and 80B to represent the loading of a ferrite sleeve surrounding both of transmission lines 78 and 80.

The first end of center signal conductor 64A of transmission line 64 is connected to a difference port 85. The second ends of shield signal conductors 78A and 80A are respectively connected to balanced-signal component ports 86 and 88. The second ends of shield conductors 78B and 80B are connected to a sum port 90. A shunt impedance 92 connects the second ends of shield conductors 78B and 80B to circuit ground 70.

Figure 6:
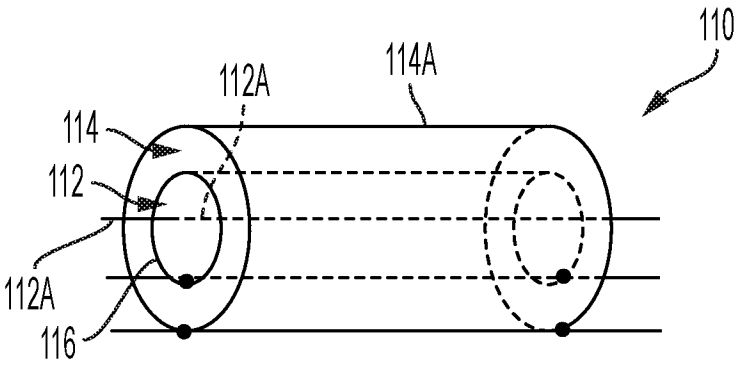
FIG. 6 is a schematic diagram of another example of paired transmission lines that may be used as baluns in the transmission-line networks of FIGS. 4, 7, and 8.
Figure 5:
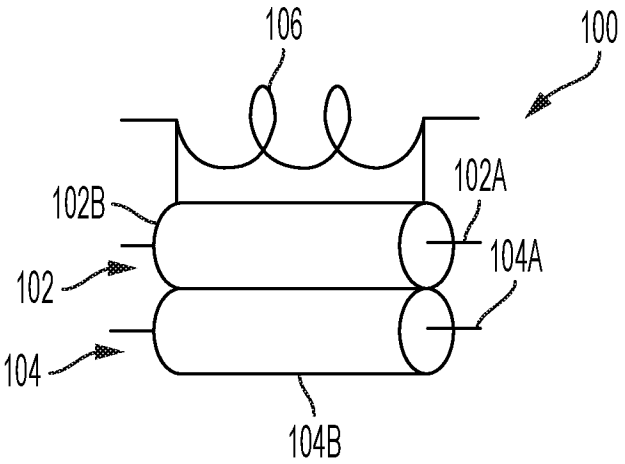
FIG. 5 is a schematic diagram of an example of paired transmission lines that may be used as baluns in the transmission-line networks of FIGS. 4, 7, and 8.

Baluns 62 and 76 may have various configurations. FIGS. 5 and 6 show two examples of paired-transmission-line baluns such as baluns 62 and 76. FIG. 5 illustrates a balun 100 having coaxial transmission lines 102 and 104. Transmission lines 102 and 104 have center signal conductors 102A and 104A and outer shield signal-return conductors 102B and 104B. An inductor 106 is connected in parallel to opposite ends of shield signal-return conductors 102B and 104B to represent the loading of a ferrite sleeve surrounding both of transmission lines 102 and 104. In balun 100, shield signal-return conductors 102B and 104B are connected together along the full lengths of the transmission lines.

FIG. 6 illustrates a coaxial balun 110 having concentric coaxial transmission lines 112 and 114. Transmission line 112 includes a center signal conductor 112A and an intermediate cylindrical signal-return conductor 116 that is coaxial with center conductor 102A. Transmission line 114 includes signal-return conductor 116 as well as an outer cylindrical signal conductor 114A that is coaxial and concentric with conductor 116. Intermediate signal-return conductor 116, which is shared by both transmission lines, isolates signal conductor 112A from signal conductor 114A.

Example 4

Figure 7:
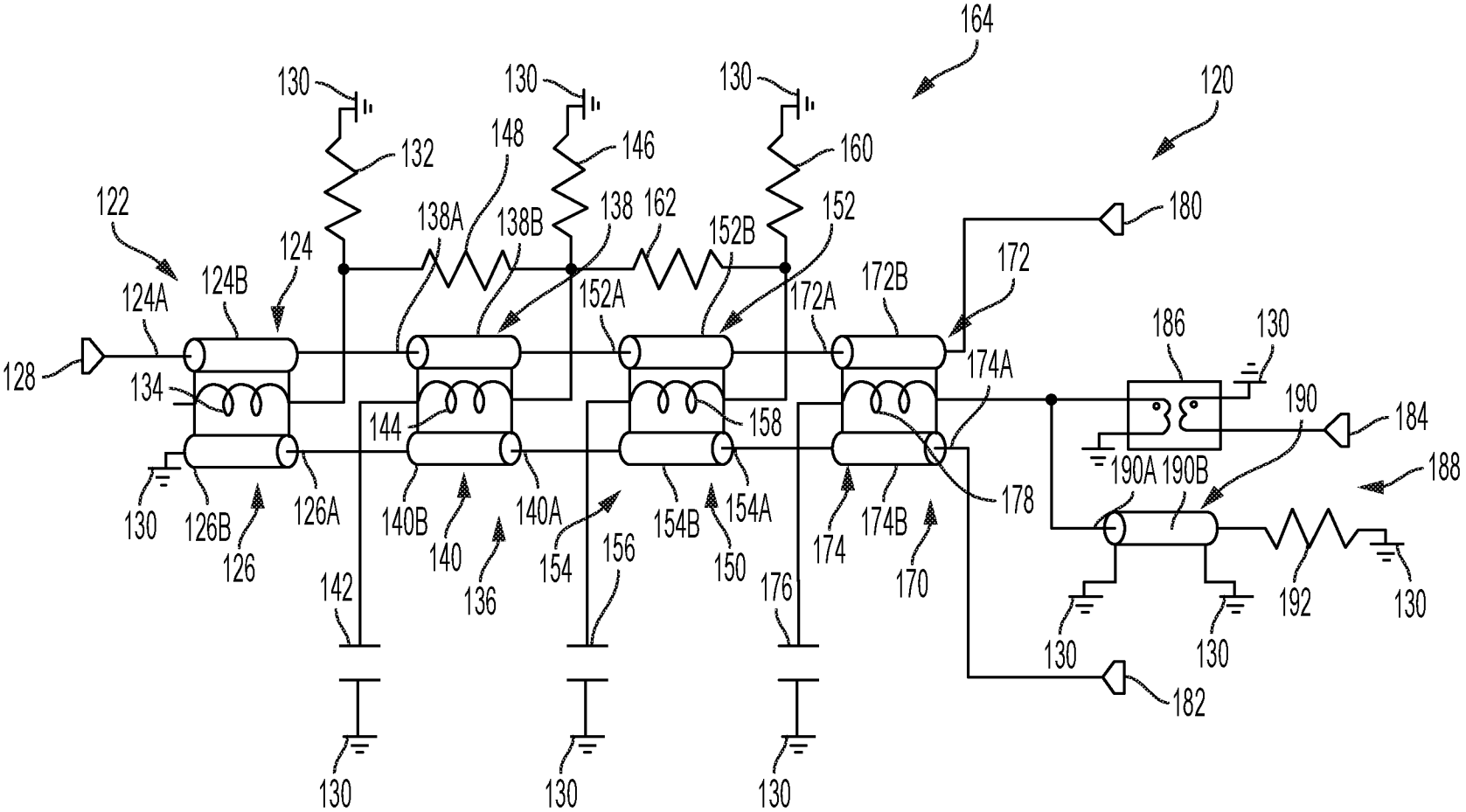
FIG. 7 is a schematic diagram showing an example of a four-port transmission-line network having four sections of paired transmission lines.

FIG. 7 illustrates a four-segment transmission-line network shown generally at 120 that is based on transmission-line pairs formed as sequential baluns. A first balun 122 includes a first transmission line 124 proximate to a second transmission line 126. Transmission lines 124 and 126 have respective center or signal conductors 124A and 126A and shield or signal-return conductors 124B and 126B. Signal or center conductors 124A and 126A are electrically isolated from each other by outer shield conductors 124B and 126B. A first end of signal conductor 124A is connected to an unbalanced-signal or difference port 128. The corresponding end of signal conductor 126A is connected to a circuit ground 130. A corresponding first end of shield conductors 124B and 126B are connected together and are otherwise open-circuited. A resistor 132 may connect the opposite, second ends of shield conductors 124B and 126B to circuit ground 130. In some examples, resistor 132 is omitted, leaving the associated end of the shield conductors open-ended. An inductor 134 is connected in parallel to opposite ends of shield signal-return conductors 124B and 126B to represent the loading of a ferrite sleeve surrounding both of transmission lines 124 and 126.

A second balun 136 is connected to the second end of balun 122. Balun 136 includes a first transmission line 138 proximate to a second transmission line 140. Transmission lines 138 and 140 have respective center or signal conductors 138A and 140A and shield or signal-return conductors 138B and 140B. Signal or center conductors 138A and 140A are electrically isolated from each other by outer shield conductors 138B and 140B. A first end of signal conductor 138A is connected to the second end of signal conductor 124A of transmission line 124. A first end of signal conductor 140A is connected to the second end of signal conductor 126A of transmission line 126. A corresponding first end of shield conductors 138B and 140B are connected together and a capacitor 142 connects these first ends of shield conductors 138B and 140B to circuit ground 130. An inductor 144 is connected in parallel to opposite ends of shield signal-return conductors 138B and 140B to represent the loading of a ferrite sleeve surrounding both of transmission lines 138 and 140. A resistor 146 may connect the opposite, second ends of shield conductors 138B and 140B to circuit ground 130. Additionally, a resistor 148 connects the second ends of signal-return conductors 124B and 126B to the second ends of signal-return conductors 138B and 140B.

A third balun 150 is connected to the second end of balun 136. Balun 150 includes a first transmission line 152 proximate to a second transmission line 154. Transmission lines 152 and 154 have respective center or signal conductors 152A and 154A and shield or signal-return conductors 152B and 154B. Signal or center conductors 152A and 154A are electrically isolated from each other by outer shield conductors 152B and 154B. A first end of signal conductor 152A is connected to the second end of signal conductor 138A of transmission line 138. A first end of signal conductor 154A is connected to the second end of signal conductor 140A of transmission line 140. A corresponding first end of shield conductors 152B and 154B are connected together and a capacitor 156 connects these first ends of shield conductors 152B and 154B to circuit ground 130. An inductor 158 is connected in parallel to opposite ends of shield signal-return conductors 152B and 154B to represent the loading of a ferrite sleeve surrounding both of transmission lines 152 and 154. A resistor 160 may connect the opposite, second ends of shield conductors 152B and 154B to circuit ground 130. Additionally, a resistor 162 connects the second ends of signal-return conductors 138B and 140B to the second ends of signal-return conductors 152B and 154B. Resistors 132, 146, 148, 160, and 162 thus form a resistor network 164 resistively linking the second ends of the first three baluns in transmission-line network 120 to each other and to ground.

A fourth and final balun 170 of transmission-line network 120 is connected to the second end of balun 152. Balun 170 includes a first transmission line 172 proximate to a second transmission line 174. Transmission lines 172 and 174 have respective center or signal conductors 172 A and 174A and shield or signal-return conductors 172B and 174B. Signal or center conductors 172A and 174A are electrically isolated from each other by outer shield conductors 172B and 174B. A first end of signal conductor 172A is connected to the second end of signal conductor 152A of transmission line 152. A first end of signal conductor 174A is connected to the second end of signal conductor 154A of transmission line 154. A corresponding first end of shield conductors 172B and 174B are connected together and a capacitor 176 connects these first ends of shield conductors 172B and 174B to circuit ground 130. An inductor 178 is connected in parallel to opposite ends of shield signal-return conductors 172B and 174B to represent the loading of a ferrite sleeve surrounding both of transmission lines 172 and 174.

The second ends of signal conductors 172A and 174A are respectively connected to balanced-signal component ports 180 and 182. The second ends of shield conductors 172B and 174B are connected together and to a sum port 184 through an impedance matching transformer 186. A shunt impedance 188 connects the second ends of shield conductors 172B and 174B to circuit ground 130. In this example, shunt impedance 188 includes the series connection of a signal conductor 190A of a transmission line 190 and a resistor 192. The ends of signal-return conductor 190B of transmission line 190 are connected to circuit ground 130, as shown.

For operation over a 4:1 bandwidth of 5 GHz to 19 GHz, with a 50 ohm impedance on difference port 128 and sum port 184, the following values were selected. The transmission lines in baluns 122, 136, 150, and 170 are a quarter wavelength long. Transmission lines 124 and 126 have impedance values of about 24.34 ohms. Transmission lines 138, 140, 152, and 154 have impedance values of about 23.91 ohms. Transmission lines 172 and 174 have impedance values of about 24.89 ohms. Resistors 132, 146, 148, 160, 162, and 192 have impedance values of 12.5 ohms, 25 ohms, 17.92 ohms, 37.5 ohms, 996.04 ohms, and 10 ohms, respectively. Capacitors 142, 156, and 176 have capacitance values of about 0.54 pF, 0.30 pF, and 2.47 pF, respectively.

Figure 8:
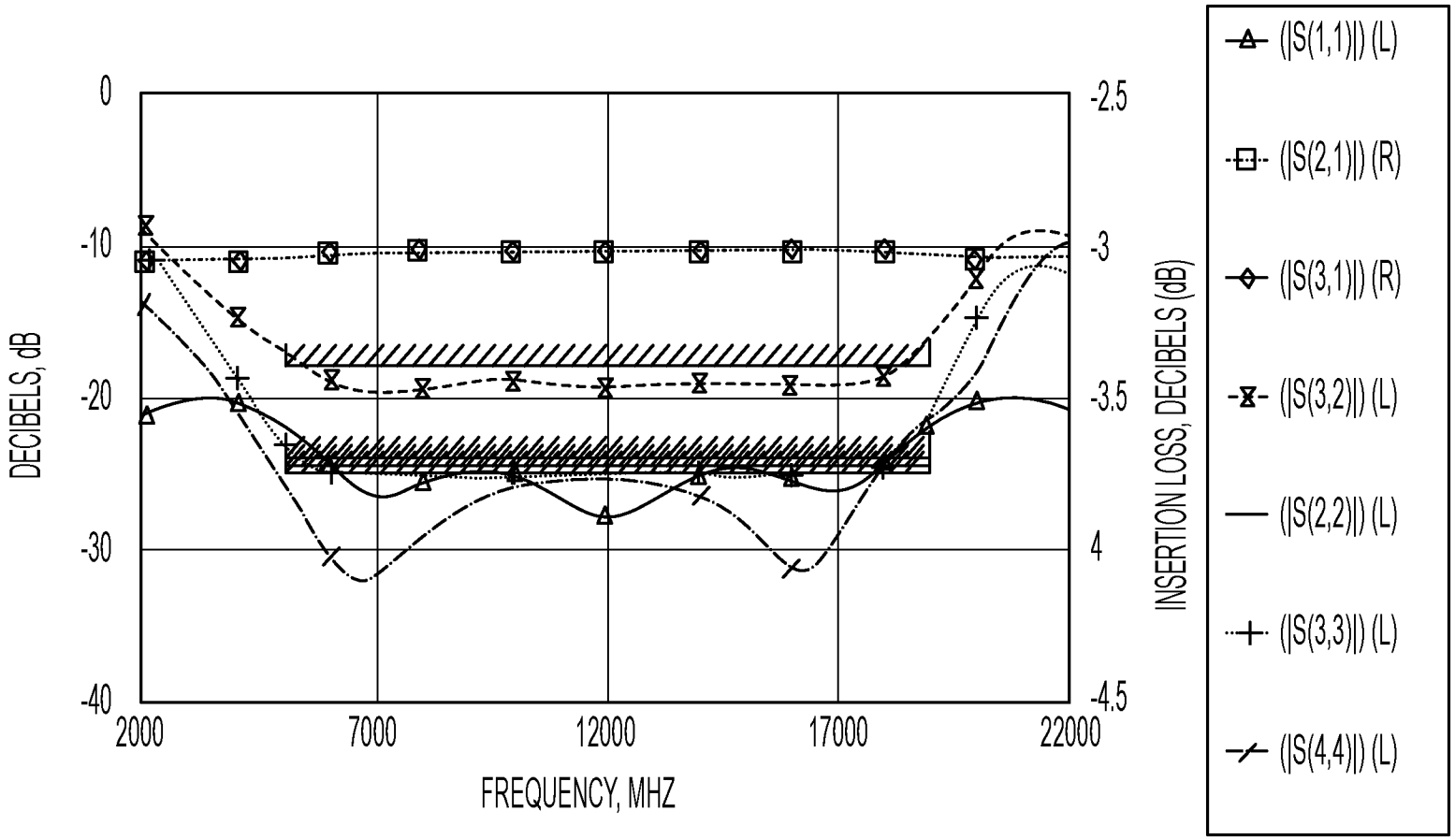
FIG. 8 is a chart illustrating the frequency response of the transmission-line network of FIG. 8 between 2 GHz and 22 GHz.

FIG. 8 is a chart illustrating a simulated frequency response for transmission-line network 120 over 2 GHz to 22 GHz. An input signal applied to difference port 128 produces signals of relatively equal magnitude but 180 degrees out of phase on component ports 180 and 182, realizing an insertion loss of close to 3 dB over the bandwidth of 5 GHz to 19 GHz. The reflection loss on all four ports is less than 20 dB over the bandwidth. The isolation between component ports 180 and 182 is below about 16 dB over the bandwidth.

Summary of Examples

This section describes aspects and features of transmission-line networks described above and are presented without limitation as a series of paragraphs, some or all of which may be alphanumerically designated for clarity and efficiency. Each of these paragraphs can be combined with one or more other paragraphs, and/or with disclosure from elsewhere in this application in any suitable manner. Some of the paragraphs below expressly refer to and further limit other paragraphs, providing without limitation examples of some of the suitable combinations.

A1. A four-port transmission-line network comprising six transmission lines with each transmission line having first and second ends, signal and signal-return conductors having corresponding respective ends, and a length corresponding to a quarter of a design-frequency wavelength. A first transmission line of the six transmission lines includes a first signal conductor and a first signal-return conductor. A first end of the first signal conductor is connected to a first port, the first end of the first signal-return conductor is connected to a circuit ground. The second end of the first signal conductor is connected to a first circuit node, and the second end of the first signal-return conductor is connected to a second circuit node. A second transmission line of the six transmission lines includes a second signal conductor and a second signal-return conductor. A first end of the second signal conductor is connected to a second port. The first end of the second signal-return conductor is connected to the circuit ground. The second end of the second signal conductor is connected to a third circuit node, and the second end of the second signal-return conductor is connected to the second circuit node. A third transmission line of the six transmission lines includes a third signal conductor and a third signal-return conductor. A first end of the third signal conductor is connected to a third port. The first end of the third signal-return conductor is connected to the circuit ground. The second end of the third signal conductor is connected to a fourth circuit node, and the second end of the third signal-return conductor is connected to the second circuit node. A fourth transmission line of the six transmission lines includes a fourth signal conductor and a fourth signal-return conductor. A first end of the fourth signal conductor is connected to the second port. The first end of the fourth signal-return conductor is connected to the circuit ground. The second end of the fourth signal conductor is connected to the first circuit node, and the second end of the fourth signal-return conductor is connected to the fourth circuit node. A fifth transmission line of the six transmission lines includes a fifth signal conductor and a fifth signal-return conductor. A first end of the fifth signal conductor is connected to the third port. The first end of the fifth signal-return conductor is connected to the circuit ground. The second end of the fifth signal conductor is connected to the first circuit node, and the second end of the fifth signal-return conductor is connected to the third circuit node. A sixth transmission line of the six transmission lines includes a sixth signal conductor and a sixth signal-return conductor. A first end of the sixth signal conductor is connected to a fourth port. The first end of the sixth signal-return conductor is connected to the circuit ground. The second end of the sixth signal conductor is connected to the fourth circuit node, and the second end of the sixth signal-return conductor is connected to the third circuit node.

A2. The transmission-line network of paragraph A1, further comprising a first inductance in parallel with the signal-return conductor of the first transmission line, a second inductance in parallel with the signal-return conductor of the fourth transmission line, a third inductance in parallel with the signal-return conductor of the fifth transmission line, and a fourth inductance in parallel with the signal-return conductor of the sixth transmission line.

A3. The transmission-line network of paragraph A1, further comprising a first inductance in parallel with the signal-return conductor of the first transmission line, a second inductance in parallel with the signal-return conductor of the fourth transmission line, and a third inductance in parallel with both of the signal-return conductors of the fifth and sixth transmission lines.

A4. The transmission-line network of paragraph A3, wherein the first, third, fourth, fifth, and sixth transmission lines are coaxial transmission lines, the respective signal-return conductors are shield conductors, and the first, second, and third inductances are respective ferrite sleeves extending around the respective coaxial transmission lines.

B1. A four-port transmission-line network comprising four transmission lines. A first transmission line includes a first conductor and a second conductor. The first conductor has a first end connected to a first port for conducting a signal relative to a circuit ground. The second conductor has a first end that is open-circuited and disposed proximate to the first end of the first conductor. A second transmission line includes a third conductor and a fourth conductor. The third conductor has a first end connected to circuit ground. The fourth conductor has first and second ends connected to respective first and second ends of the second conductor, and the first end of the fourth conductor is proximate to the first end of the third conductor. A first capacitor is connected to circuit ground. A third transmission line includes a fifth conductor and a sixth conductor. The fifth conductor has a first end connected to a second end of the first conductor and a second end connected to a second port. The sixth conductor has first and second ends that are proximate to respective first and second ends of the fifth conductor. A fourth transmission line including a seventh conductor and an eighth conductor. The seventh conductor has a first end connected to the second end of the third conductor and a second end connected to a third port. The eighth conductor has first and second ends connected to respective first and second ends of the sixth conductor. The first and second ends of the eighth conductor are proximate to respective first and second ends of the seventh conductor. The first ends of the sixth and eighth conductors are connected to the first capacitor, and the second ends of the sixth and eighth conductors are connected to a fourth port.

B2. The transmission-line network of paragraph B1, further comprising a first resistor connecting the second ends of the second and fourth conductors to circuit ground.

B3. The transmission-line network of paragraph B1, wherein the second conductor and the fourth conductor are the same conductor.

B4. The transmission-line network of paragraph B1, wherein the first and second transmission lines are coaxial transmission lines, the first and third conductors are center conductors, and the second and fourth conductors are shield conductors that are connected together along their lengths.

B5. The transmission-line network of paragraph B1, further comprising a second capacitor connected to circuit ground, and fifth and sixth transmission lines. The fifth transmission line includes a fifth conductor and a sixth conductor. The fifth conductor has a first end connected to a second end of the first conductor and a second end connected the first end of the fifth conductor. The tenth conductor has first and second ends that are proximate to respective first and second ends of the ninth conductor. The sixth transmission line includes an eleventh conductor and a twelfth conductor. The eleventh conductor has a first end connected to the second end of the third conductor and a second end connected to the first end of the seventh conductor. First and second ends of the twelfth conductor are proximate to respective first and second ends of the eleventh conductor and are connected to respective first and second ends of the tenth conductor. The first ends of the tenth and twelfth conductors are connected to the second capacitor.

B6. The transmission-line network of paragraph B5, further comprising a first resistor connecting the second ends of the second and fourth conductors to circuit ground and a second resistor connecting the second ends of the tenth and twelfth conductors to circuit ground.

B7. The transmission-line network of paragraph B6, further comprising a third resistor connecting the second ends of the second and fourth conductors with the second ends of the second ends of the tenth and twelfth conductors.

B8. The transmission-line network of paragraph B6, further comprising a third resistor and a seventh transmission line connected in series between the second ends of the sixth and eighth conductors and circuit ground.

The disclosure set forth above may encompass multiple distinct inventions with independent utility. Although each of these inventions has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only, and do not constitute a characterization of any claimed invention. The subject matter of the invention(s) includes all novel and nonobvious combinations and subcombinations of the various elements, features, functions, and/or properties disclosed herein. The following claims particularly point out certain combinations and subcombinations regarded as novel and nonobvious. Invention(s) embodied in other combinations and subcombinations of features, functions, elements, and/or properties may be claimed in applications claiming priority from this or a related application. Such claims, whether directed to a different invention or to the same invention, and whether broader, narrower, equal, or different in scope to the original claims, also are regarded as included within the subject matter of the invention(s) of the present disclosure.

The invention claimed is:

1. A four-port transmission-line network comprising:

a first transmission line including a first conductor and a second conductor, wherein the first conductor has a first end connected to a first port for conducting a signal relative to a circuit ground, the second conductor has a first end that is open-circuited and disposed proximate to the first end of the first conductor;

a second transmission line including a third conductor and a fourth conductor, wherein the third conductor has a first end connected to circuit ground, the fourth conductor has first and second ends connected to respective first and second ends of the second conductor, and the first end of the fourth conductor is proximate to the first end of the third conductor;

a first capacitor connected to circuit ground;

a third transmission line including a fifth conductor and a sixth conductor, wherein the fifth conductor has a first end connected to a second end of the first conductor and a second end connected to a second port, the sixth conductor has first and second ends that are proximate to respective first and second ends of the fifth conductor; and a fourth transmission line including a seventh conductor and an eighth conductor, wherein the seventh conductor has a first end connected to the second end of the third conductor and a second end connected to a third port, the eighth conductor has first and second ends connected to respective first and second ends of the sixth conductor, the first and second ends of the eighth conductor are proximate to respective first and second ends of the seventh conductor, the first ends of the sixth and eighth conductors are connected to the first capacitor, and the second ends of the sixth and eighth conductors are connected to a fourth port.

2. The transmission-line network of claim 1, further comprising a first resistor connecting the second ends of the second and fourth conductors to circuit ground.

3. The transmission-line network of claim 1, wherein the second conductor and the fourth conductor are the same conductor.

4. The transmission-line network of claim 1, wherein the first and second transmission lines are coaxial transmission lines, the first and third conductors are center conductors, and the second and fourth conductors are shield conductors that are connected together along their lengths.

5. The transmission-line network of claim 1, further comprising:

a second capacitor connected to circuit ground;

a fifth transmission line including a fifth conductor and a sixth conductor, wherein the fifth conductor has a first end connected to a second end of the first conductor and a second end connected the first end of the fifth conductor, the tenth conductor has first and second ends that are proximate to respective first and second ends of the ninth conductor; and a sixth transmission line including an eleventh conductor and a twelfth conductor, wherein the eleventh conductor has a first end connected to the second end of the third conductor and a second end connected to the first end of the seventh conductor, the twelfth conductor has first and second ends of the twelfth conductor are proximate to respective first and second ends of the eleventh conductor and are connected to respective first and second ends of the tenth conductor, and the first ends of the tenth and twelfth conductors are connected to the second capacitor.

6. The transmission-line network of claim 5, further comprising a first resistor connecting the second ends of the second and fourth conductors to circuit ground and a second resistor connecting the second ends of the tenth and twelfth conductors to circuit ground.

7. The transmission-line network of claim 6, further comprising a third resistor connecting the second ends of the second and fourth conductors with the second ends of the second ends of the tenth and twelfth conductors.

8. The transmission-line network of claim 6, further comprising a third resistor and a seventh transmission line connected in series between the second ends of the sixth and eighth conductors and circuit ground.

* * * * *